US005996351A

United States Patent [19]

Feitelberg et al.

[11] Patent Number: 5,996,351

[45] Date of Patent: Dec. 7, 1999

[54] RAPID-QUENCH AXIALLY STAGED COMBUSTOR

[75] Inventors: Alan S. Feitelberg; Mark Christopher Schmidt, both of Niskayuna; Steven George Goebel, Clifton Park, all of N.Y.

[73] Assignee: General Electric Company, Schenectady, N.Y.

[21] Appl. No.: 08/888,252

[22] Filed: Jul. 7, 1997

[51] Int. Cl.[6] ..... F02C 1/00

[52] U.S. Cl. ..... 60/732; 60/754

[58] Field of Search ..... 60/732, 733, 752, 60/754

[56] References Cited

U.S. PATENT DOCUMENTS

| | | | |
|---|---|---|---|
| 4,845,940 | 7/1989 | Beer . | |
| 4,893,475 | 1/1990 | Willis | 60/732 |
| 5,103,630 | 4/1992 | Correa . | |
| 5,289,686 | 3/1994 | Razdan et al. | 60/752 |
| 5,437,158 | 8/1995 | Fric . | |
| 5,479,781 | 1/1996 | Fric et al. . | |

FOREIGN PATENT DOCUMENTS

| | | | |
|---|---|---|---|
| 2116308 | 9/1983 | United Kingdom | 60/732 |

OTHER PUBLICATIONS

Battista et al., "Design and Performance of Low Heating Value Fuel Gas Turbine Combustors", American Society of Mechanical Engineers, Paper No. 96–GT–531 (1996), pp. 1–9.

Heap et al., "Environmental Aspects of Low BTU Gas Combustion", Sixteenth Symposium (International) on Combustion, The Combustion Institute (1977), pp. 535–542.

MB Cutrone, "Low NOx Heavy Fuel Combustor Concept Program Phase 1A Gas Tests", NASA CR–167877 (Apr. 1982).

*Primary Examiner*—Charles G. Freay
*Attorney, Agent, or Firm*—Patrick K. Patnode; Marvin Snyder

[57] ABSTRACT

A combustor cooperating with a compressor in driving a gas turbine includes a cylindrical outer combustor casing. A combustion liner, having an upstream rich section, a quench section and a downstream lean section, is disposed within the outer combustor casing defining a combustion chamber having at least a core quench region and an outer quench region. A first plurality of quench holes are disposed within the liner at the quench section having a first diameter to provide cooling jet penetration to the core region of the quench section of the combustion chamber. A second plurality of quench holes are disposed within the liner at the quench section having a second diameter to provide cooling jet penetration to the outer region of the quench section of the combustion chamber. In an alternative embodiment, the combustion chamber quench section further includes at least one middle region and at least a third plurality of quench holes disposed within the liner at the quench section having a third diameter to provide cooling jet penetration to at least one middle region of the quench section of the combustion chamber.

30 Claims, 5 Drawing Sheets

FUEL INJECTOR
10
12
14
16
18
19
20
21
22
23
24
26
28
30
34
36
38
41
42
46
48
50
52
54
56
58
60

RAPID-QUENCH AXIALLY STAGED COMBUSTOR

This invention was made with Government support under Government Contract No. DEAC21-87-MC23170 awarded by the Department of Energy (DOE). The Government has certain rights to this invention.

BACKGROUND OF THE INVENTION

This application relates to turbine combustion, and in particular relates to a rich-quench-lean turbine combustor with low NOx and CO emissions.

Over the past ten years there has been a dramatic increase in the regulatory requirements for low emissions from turbine power plants. Environmental agencies throughout the world are now requiring low rates of emissions of NOx, CO and other pollutants from both new and existing turbines.

Traditional turbine combustors use non-premixed diffusion flames where fuel and air freely enter the combustion chamber separately. Typical diffusion flames are dominated by regions that burn at or near stoichiometric conditions. The resulting flame temperatures can exceed 3000° F. (1650° C.). Because diatomic nitrogen reacts rapidly with oxygen at temperatures exceeding about 2850° F. (1565° C.), diffusion flames typically produce relatively high levels of NOx emissions.

One method commonly used to reduce peak temperatures, and thereby reduce NOx emissions, is to inject water or steam into the combustor. Water or steam injection, however, is a relatively expensive technique and can cause the undesirable side effect of quenching carbon monoxide (CO) burnout reactions. Additionally, water or steam injection methods are limited in their ability to reach the extremely low levels of pollutants now required in many localities.

Another method to reduce NOx emissions is by utilizing a rich-quench-lean (ROL) gas turbine combustor. In a rich-quench-lean combustor, a combustor is divided into a fuel rich stage, a quench stage and a fuel lean stage. In the fuel rich stage, (rich meaning an equivalence ratio $\emptyset>1$), a fuel-air mixture is partially burned because the fuel-air mixture is introduced with an insufficient amount of air to complete combustion. [Note that equivalence ratio is fuel/air ratio normalized by the stoichiometric fuel/air ratio, $\emptyset=1$ for stoichiometric conditions, $\emptyset>1$ for fuel rich conditions, and $\emptyset<1$ for fuel lean conditions.] Fuel rich combustion is desirable because a large portion of any bound nitrogen species (for example, $NH_3$) in the fuel will be converted into $N_2$ during combustion within the rich stage. By converting the reactive bound nitrogen species to relatively non-reactive $N_2$, emissions of NOx are reduced.

Next, additional air, termed in the art to be "quench air", is added downstream from the rich stage to complete combustion within a lean stage. If the quench air is not uniformly and rapidly introduced, however, high NOx levels will be produced in local regions of the combustor due to high temperatures. Although rapid mixing can be achieved with a high pressure drop, this reduces the overall efficiency of the turbine.

Therefore, it is apparent from the above that there exists a need in the art for improvements in rich-quench-lean combustor design to achieve rapid mixing of quench air and rich stage burned gas while maintaining low emission levels and low pressure drop across the quench stage.

SUMMARY OF THE INVENTION

A combustor cooperating with a compressor in driving a gas turbine includes a cylindrical outer combustor casing. A combustion liner, having an upstream rich section, a quench section and a downstream lean section, is disposed within the outer combustor casing defining a combustion chamber having at least a core quench region and an outer quench region. A first plurality of quench holes are disposed within the liner at the quench section having a first diameter to provide cooling jet penetration to the core region of the quench section of the combustion chamber. A second plurality of quench holes are disposed within the liner at the quench section having a second diameter to provide cooling jet penetration to the outer region of the quench section of the combustion chamber. In an alternative embodiment, the combustion chamber quench section further includes at least one middle region and at least a third plurality of quench holes disposed within the liner at the quench section having a third diameter to provide cooling jet penetration to at least one middle region of the quench section of the combustion chamber.

DETAILED DESCRIPTION OF THE INVENTION

Figure 1:
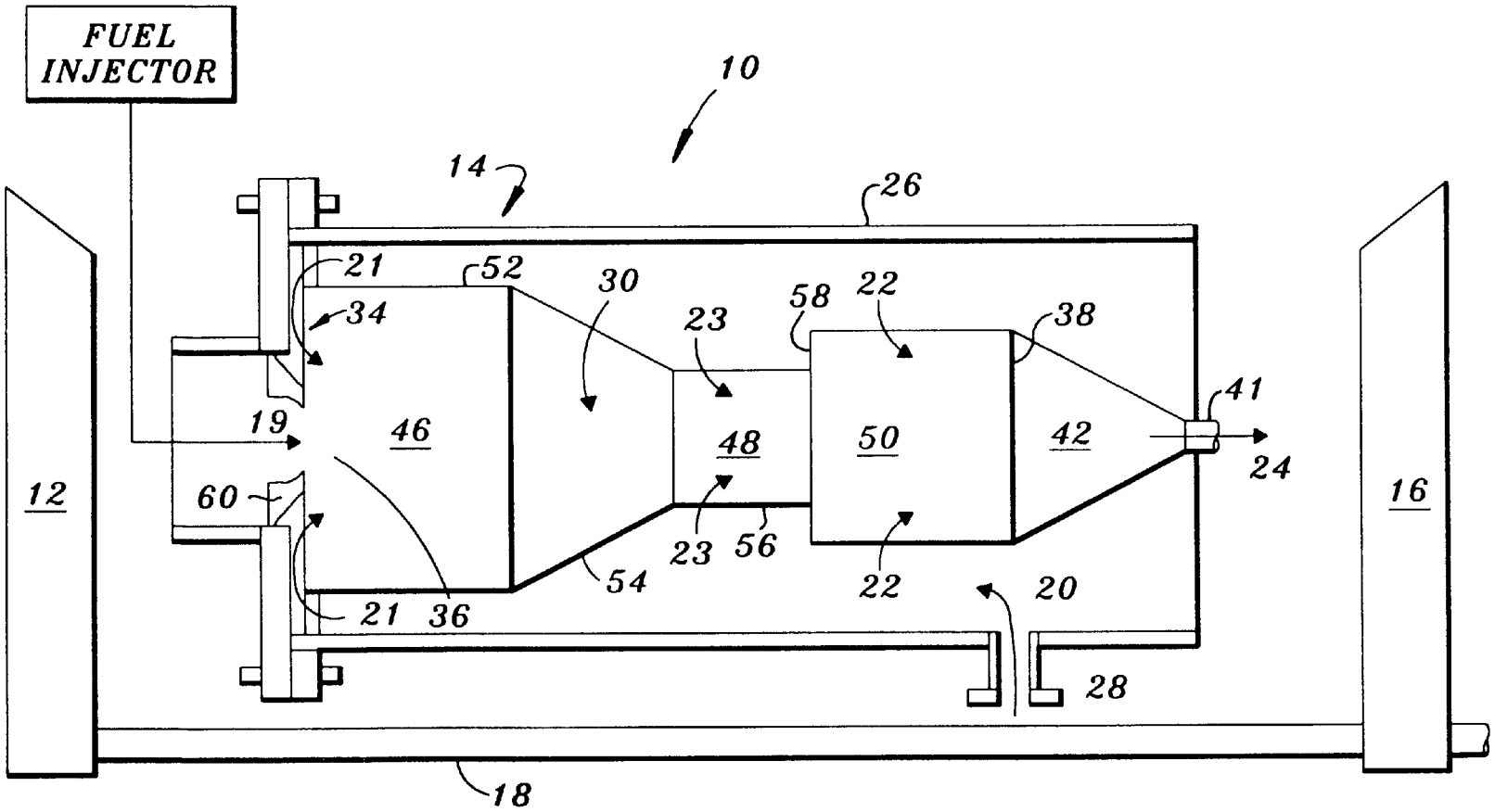
FIG. 1 is a cross-sectional side view of a turbine engine in accordance with the instant invention.

An industrial turbine engine 10 includes a compressor 12 disposed in serial flow communication with a rich-quench-lean combustor 14 and a single or multi-stage turbine 16, as shown in FIG. 1. Turbine 16 is coupled to compressor 12 by a drive shaft 18, a portion of which drive shaft 18 extends for powering an electrical generator (not shown) for generating electrical power. During operation, compressor 12 discharges compressed air 20 into combustor 14 wherein compressed air 20 is mixed with fuel 19, as discussed below, and ignited for generating combustion gases 24 from which energy is extracted by turbine 16 for rotating shaft 18 to power compressor 12, as well as producing output power for driving the generator or other external load.

Compressed air 20 is divided into rich stage air 21, lean stage air 22, and quench air 23 through appropriate apportionment of the open areas throughout a combustion liner 32.

In this exemplary embodiment, combustor 14 comprises a cylindrical outer combustor casing 26 which has at least one air inlet 28 for supplying air to combustor 14. Circumferentially disposed within outer combustor casing 26 are a plurality of circumferentially adjoining combustion chambers 30, each defined by tubular combustion liner 32. Each combustion chamber 30 further includes a generally flat dome 34 at an upstream end 36 and an outlet 38 at a downstream end 40. A transition piece 42 joins the several can outlets 38 to effect a common discharge of combustion gases 24 through an exhaust 44 to turbine 16.

In accordance with the instant invention, combustor 14 includes a rich section 46 at upstream end 36, a quench section 48 and a downstream lean section 50. Rich section 46 consists of a generally cylindrical section 52 followed by a conical section 54, which conical section 54 reduces the diameter of the flow path. Conical section 54 is necessary to prevent a low pressure core of the recirculating flow from drawing lean section 50 gases upstream into rich section 46. Conical section 54 also provides a convenient method of reducing the flow area to a reasonable size for quenching.

Following rich section 46 is necked-down quench section 48 where quench air 23 is introduced and mixed with the products of combustion in the final lean section 50. Quench section 48 consists of a cylindrical section 56 and a backward facing step 58 at the entrance to lean section 50. Backward facing step 58 enhances the combustion stability and mixing in lean section 50 by creating a recirculation zone at the entrance to lean section 50.

A fuel nozzle 60 is located ahead of rich stage 46 to introduce fuel 19 and rich stage air 21 within combustor 14 so as to produce a swirl stabilized rich stage diffusion flame. Several examples of methods of introducing the fuel and air into the combustor with a fuel nozzle, are described in "*Design and Performance of Low Heating Value Fuel Gas Turbine Combustors*," by R. A. Battista, A. S. Feitelberg, and M. A. Lacey, American Society of Mechanical Engineers, Paper No. 96-GT-531, which paper is herein incorporated by reference.

Figure 2:
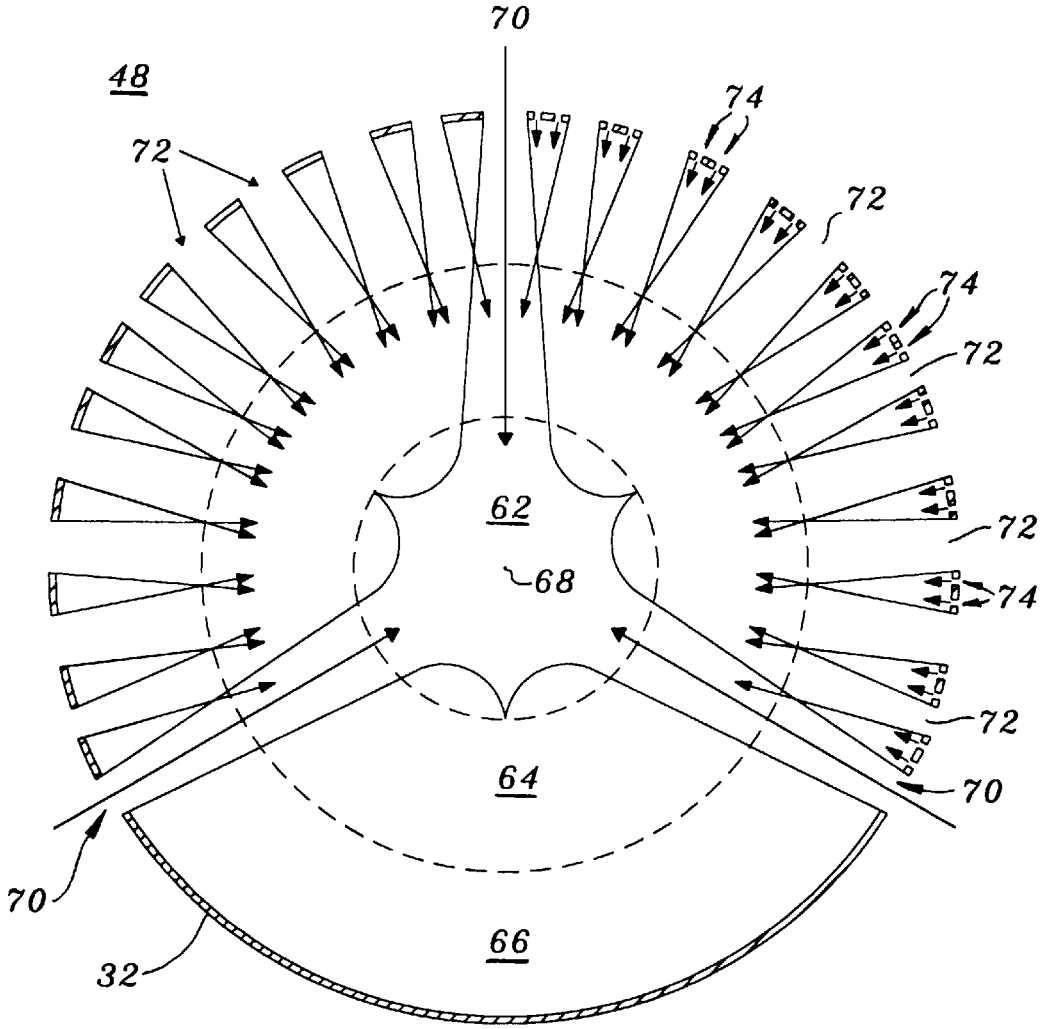
FIG. 2 is a plan view of a quench section in accordance with the instant invention, including a core region, a middle region and an outer region.

In accordance with one embodiment of the instant invention, quench section 48 is divided, for purposes of calculating quench air needs as discussed below, into three separate regions, a core region 62, a middle region 64, and an outer region 66, as shown in FIG. 2. As used herein, the term region, for example outer region 66, as used in reference to quench section 48 does not refer to physical separations or barriers or the like dividing quench section 48. Instead, the term region, as used in reference to quench section 48 refers to apportionment of quench section for purposes of calculating quench air needs.

In one embodiment, herein termed an "equal radii" embodiment, as measured from a centerpoint 68 (i.e., the center of symmetry for liner 32), core region 62 occupies the space between centerpoint 68 and one third of the radial distance between centerpoint 68 and combustion liner 32. Middle region occupies the space between one third of the radial distance and two thirds of the radial distance from centerpoint 68 and combustion liner 32, and outer region 66 occupies the space between two thirds of the radial distance and combustion liner 32. Accordingly, core region 62 is essentially circular in cross section, while middle region 64 and outer region 66 are essentially annular in cross section, as shown in FIG. 2.

In another embodiment, herein termed an "equal area" embodiment, core region 62 occupies one third of the cross-sectional area of quench section 48, middle region 64 occupies one third of the cross-sectional area of quench section 48 and outer region 66 occupies one third of the cross-sectional area of quench section 48. In both the "equal radii" embodiment and the "equal area" embodiment, the fraction of the total quench air apportioned to any region is equal to the fraction of the cross-sectional area occupied by that region.

In accordance with one embodiment of the instant invention, a first plurality of quench holes 70 are circumferentially distributed about combustion liner 32 at quench section 48, as shown in FIG. 2. First plurality of quench holes 70 are sized so as to provide cooling jet penetration to core region 62 of quench section 48. Larger quench holes create larger jets having greater momentum, enabling greater penetration into a hot gas flow. A second plurality of quench holes 72 are circumferentially distributed about combustion liner 32 at quench section 48. Second plurality of quench holes 78 are sized so as to provide cooling jet penetration to middle region 64 of quench section 48. A third plurality of quench holes 74 are circumferentially distributed about combustion liner 32 at quench section 48. Third plurality of quench holes 74 are sized so as to provide cooling jet penetration to outer region 66 of quench section 48. Accordingly, a rapid mixing quench is accomplished by forcing relatively uniform distribution of the quench air into the radially stratified core region 62, middle region 64 and outer region 66.

Each set of quench holes is sized using standard correlations for jets penetrating into a cross flow, as discussed below. Since a significant portion of combustion liner 32 is removed for the quench holes about quench section 48, a double thickness liner 32 may be utilized at quench section 48 to maintain overall structural integrity of combustion liner 32.

In one embodiment of the instant invention, first plurality of quench holes 70 comprise between about two to about ten quench holes with a diameter in the range between about 0.1 in. to about 0.3 in. First plurality of quench holes 70 are spaced about the periphery of quench section 48, each angularly spaced in the range between about 30° to about 180° apart from one another. Second plurality of quench holes 72 comprise between about twenty to about sixty quench holes with a diameter in the range between about 0.05 in. to about 0.2 in. Second plurality of quench holes 72 are spaced about the periphery of quench section 48, each angularly spaced in the range between about 5° to about 20° apart from one another. In one embodiment, second plurality of quench holes 72 are axially offset from first plurality of quench holes 70 in the range between about 0.05 in. to about 0.3 in. As used herein, the term "offset" refers to respective quench holes disposed such that one set of quench holes is located closer to upstream rich section and the other set of quench holes is located closer to downstream lean section. Third plurality of quench holes 74 comprise between about one hundred to about five hundred quench holes with a diameter in the range between about 0.005 in. to about 0.1 in. Third plurality of quench holes 74 are spaced about the periphery of quench section 48, each angularly spaced in the range between about 0.5° to about 7° apart from one another. In one embodiment, third plurality of quench holes 74 comprise two spaced bands of quench holes 74 axially offset by a distance between about 0.05 in. to about 0.1 in. In one embodiment, third plurality of quench holes 74 are axially offset from first plurality of quench holes 70 in the range between about 0.1 in. to about 0.3 in and from second plurality of quench holes 72 in the range between about 0.05 in. to about 0.2 in.

In one embodiment, each region 72, 74, 76 receives an amount of quench air which is proportional to a region's respective cross-sectional area. In one embodiment having regions of equal radius, core region 62 receives about 11% of the quench air, while middle region 64 and outer region 66 receive about 32% and about 56% of the quench air, respectively. Such an arrangement allows the distribution of quench air to be proportional to the cross-sectional area of the respective regions. In an alternative embodiment having regions of equal cross-sectional area, core region 62, middle region 64 and outer region 66 each receive about 33% of the available quench air.

Figure 3:
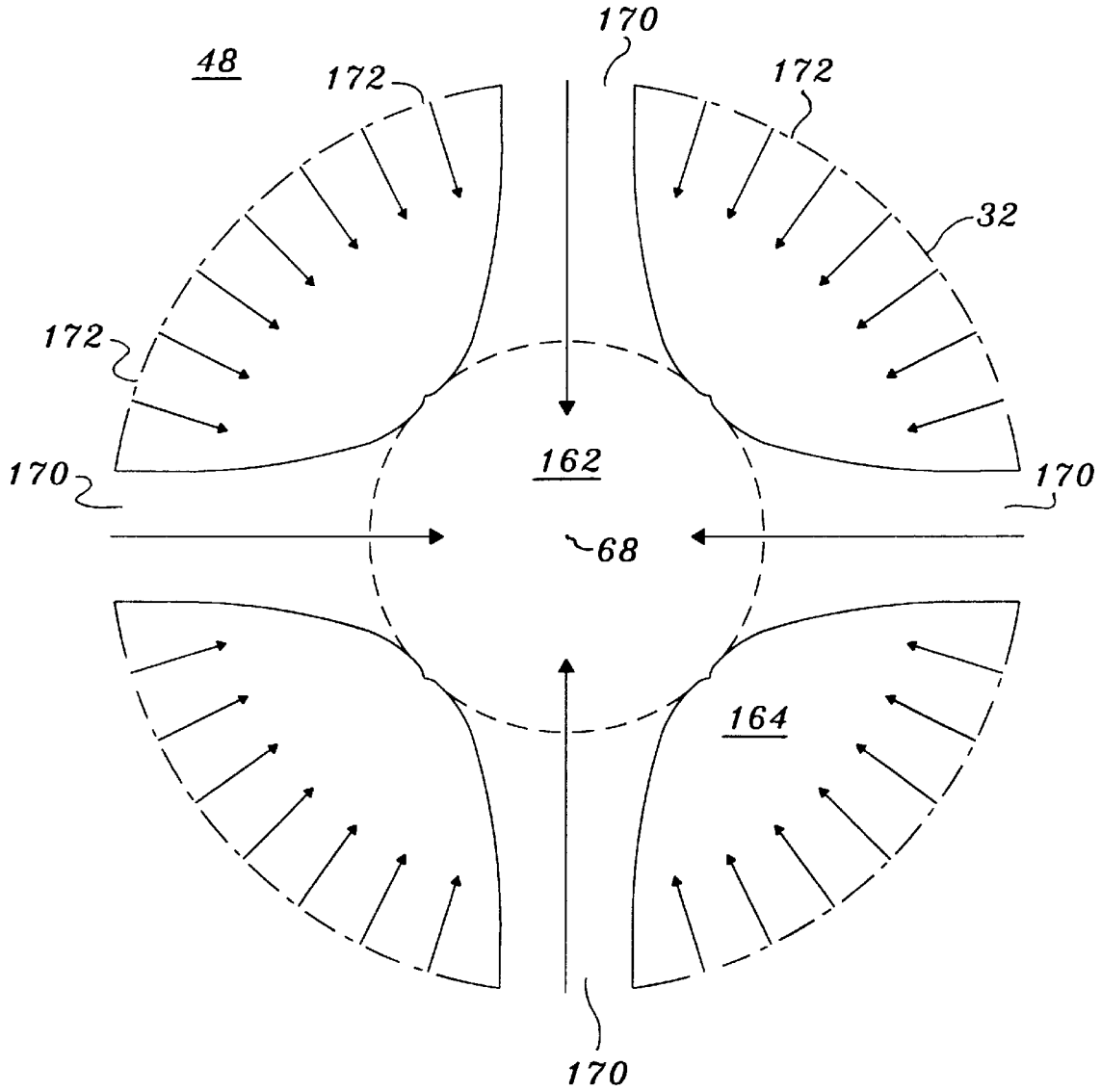
FIG. 3 is a plan view of a quench section in accordance with the instant invention, including a core region and an outer region.

In accordance with another embodiment of the instant invention, quench section 48 is divided into two separate regions, a core region 162, and an outer region 164, as shown in FIG. 3.

In an "equal radii" embodiment, core region 162 occupies the space between a centerpoint 68 and one half of the radial distance between centerpoint 68 and combustion liner 32 and outer region 164 occupies the space between one half of the radial distance, measured from centerpoint 68, and the combustion liner 32. Accordingly, inner region 62 is circular in cross section while outer region 66 is annular in cross section, as shown in FIG. 3.

In an "equal area" embodiment, inner region 162 occupies one half of the cross-sectional area of quench section 48 and outer region 164 occupies one half of the cross-sectional area of quench section 48.

In accordance with one embodiment of the instant invention, a first plurality of quench holes 170 are disposed within combustion liner 32 at quench section 48, as shown in FIG. 3. First plurality of quench holes 170 are sized so as to provide cooling jet penetration to inner region 162 of quench section 48. A second plurality of quench holes 172 are disposed within combustion liner 32 at quench section 48. Second plurality of quench holes 172 are sized so as to provide cooling jet penetration to outer region 164 of quench section 48. Each set of quench holes is sized using standard correlations for jets penetrating into a cross flow.

In one embodiment of the instant invention, first plurality of quench holes 170 comprise between about two to about ten quench holes with a diameter in the range between about 0.1 in. to about 2.0 in. First plurality of quench holes 170 are spaced about the periphery of quench section 48, each angularly spaced in the range between about 30° to about 180° apart from one another. Second plurality of quench holes 172 comprise between about twenty to about sixty quench holes with a diameter in the range between about 0.05 in. to about 0.3 in. Second plurality of quench holes 172 are spaced about the periphery of quench section 48, each angularly spaced in the range between about 5° to about 20° apart from one another. In one embodiment, second plurality of quench holes 172 are axially offset from first plurality of quench holes 170 in the range between about 0.05 in. to about 0.3 in.

In one embodiment, each region 162, 164 receives an amount of quench air which is proportional to a region's respective cross-sectional area. Such an arrangement allows the distribution of quench air to be proportional to the area of the respective regions. In one embodiment having regions of equal area, inner region 162, and outer region 164 each receive about 50% of the available quench air.

Figure 4:
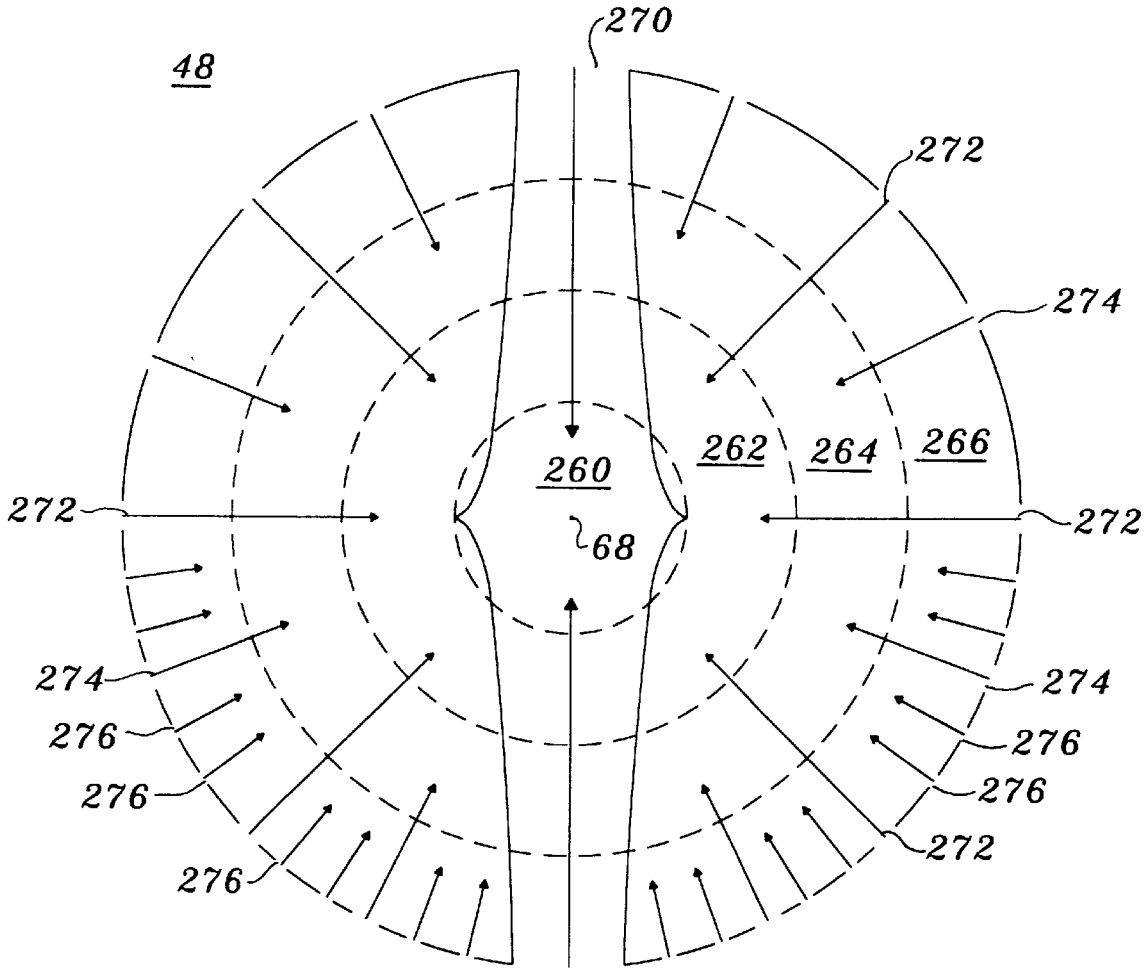
FIG. 4 is a plan view of a quench section in accordance with the instant invention, including a core region, a first middle region, a second middle region, and an outer region.

In accordance with another embodiment of the instant invention, quench section 48 is divided into four separate regions, a core region 260, a first middle region 262, a second middle region 264 and an outer region 266, as shown in FIG. 4.

In an "equal radii" embodiment, core region 260 occupies the space between a centerpoint 68 and one fourth of the radial distance between centerpoint 68 and combustion liner 32, first middle region 262 occupies the space between one four of the radial distance between centerpoint 68 and combustion liner 32 and one half of the radial distance between centerpoint 68 and combustion liner 32, second middle region 264 occupies the space between one half of the radial distance between centerpoint 68 and combustion liner 32 and three fourths of the radial distance and outer region 266 occupies the space between three fourths of the radial distance between centerpoint 68 and combustion liner 32.

In an "equal area" embodiment, core region 260, first middle region 262, second middle region 264 and outer region 266 each occupy one fourth of the cross-sectional area of quench section 48.

In accordance with one embodiment of the instant invention, a first plurality of quench holes 270 are disposed within combustion liner 32 at quench section 48, as shown in FIG. 4. First plurality of quench holes 270 are sized so as to provide cooling jet penetration to core region 260 of quench section 48. A second plurality of quench holes 272 are disposed within combustion liner 32 at quench section 48. Second plurality of quench holes 272 are sized so as to provide cooling jet penetration to first middle region 262 of quench section 48. A third plurality of quench holes 274 are disposed within combustion liner 32 at quench section 48. Third plurality of quench holes 274 are sized so as to provide cooling jet penetration to second middle region 264. A fourth plurality of quench holes 276 are disposed within combustion liner 32 at quench section 48. Fourth plurality of quench holes 276 are sized so as to provide cooling jet penetration to outer region 266. Each set of quench holes is sized using standard correlations for jets penetrating into a cross flow.

In either an "equal radii" embodiment or an "equal area" embodiment of the instant invention, the number and diameter of each type of quench hole is readily determined using the method of the present invention disclosed below.

First, the total open area of a respective combustor liner is determined from the desired total air and fuel flow rates, operating pressure, compressor discharge air temperature and desired total pressure drop. A typical can-annular gas turbine combustor may have a nominal total open area, for example, of 30 $in^2$, a nominal air mass flow rate of, for example, 20 lb/s, operate at a nominal pressure of 8 atm, a nominal compressor discharge temperature of 620° and have a nominal total pressure drop of 2.5%. These values are for illustrative purposes only and do not limit the instant invention to a particular size or class of turbine.

Next, the fraction of the open area apportioned to each of the rich section, the quench section, and the lean section is determined. The rich stage open area is typically chosen to allow only enough air into the rich stage to create an equivalence ratio of between about 1.1 to about 1.8. The quench stage open area is typically chosen to allow enough air into the combustor to generate a fuel-lean mixture at a temperature between about 2000 F. (1095 C.) to about 2750 F. (1510 C.). The lean stage open area is apportioned to allow enough air into the combustor to lower the burned gas temperature to the desired turbine inlet temperature range.

After the total quench stage open area is chosen, the designer(s) selects either the "equal radii" or "equal area" embodiment, and chooses to the divide the quench section into two regions (a core region and an outer region), three regions (a core region, a middle region and an outer region), or more regions. Next, the quench holes are sized so that the maximum radial jet penetration distance, $Y_{max}$, will penetrate to about the center of a respective region (i.e., core region, middle region, outer region, etc.) To determine the hole diameter, $d_{hole}$, required to achieve any particular $Y_{max}$, the following equation is used:

$$\frac{Y_{\max}}{d_{hole}} = 1.15\sqrt{\frac{\rho_j v_j^2}{\rho_b v_b^2}};$$

where $\rho_j$=the density of quench air jet; $\rho_b$=the mass density of the burned gas in the quench section; $v_j$=the velocity of the quench air jet; $v_b$=the velocity of the burned gas in the quench section and $d_{hole}$=the diameter of the quench hole.

The required number of holes of each diameter is then readily determined from the fractional apportionment of the quench air to the respective quench regions.

The illustrative e example below demonstrates the application of this technique in sufficient detail for one skilled in the art to apply this design method to any particular conditions of interest. This example is meant to illustrate the technique, and not limit the application to any particular set of conditions.

Consider a case in which the designer has determined the total combustor liner open area must be 30 $in^2$ to achieve the desired pressure drop. The designer has further determined that the rich stage must receive 40% of the total air flow to operate at the desired fuel rich equivalence ratio (e.g., Ø=1.2), the quench stage must receive 45% of the total air flow to reach the desired quench temperature (e.g., T=2650° F.), and the lean stage must receive 15% of the total air flow to reach the desired combustor exit temperature (e.g., 2350° F.). In this example the total quench air jet open area is $$0.45*30\ in^2=13.5\ in^2=0.00871\ m^2$$

If the designer further chooses a quench stage diameter of 8 inches, and also chooses to divide the quench section into two region of equal area. In this case, the core region will have radius of 2.83", the outer region will extend 1.17" inward from the combustor wall, and the quench stage will have two sets of holes. The large holes will create jets with a maximum penetration depth $Y_{max}$ of 2.59 inches, and the small holes will create jets with a maximum penetration depth $Y_{max}$ of 0.59 inches. The total open area for the large holes will be 50% of the total quench hole open area, or $0.5*13.5\ in^2=6.75\ in^2$.

The designer next calculates the dimensionless ratio $Y_{max}/d_{hole}$, using the known mass density of the quench air and the burned gas in the quench section, as well as the velocity of the quench air jet and the burned gas flowing through the quench section. In this example, we will assume the combustor operating pressure is 147 psia. Using the quench section burned gas temperature of 2650° F., the mass density in the quench section will be about $\rho_b$=1.9 kg/$m^3$. Assuming a typical compressor discharge temperature of 720° F., the quench air density will be about $\rho_j$=5.3 kg/$m^3$.

The velocity through the quench section is readily calculated using the known geometry. Using a total combustor air flow of 20 lb/s, the flow through the quench section is 85% of the total (rich air+quench air), or 17 lb/s (7.7 kg/s). So the volumetric flow through the quench section is $$7.7\ kg/s \div 1.9\ kg/m^3=4.1\ m^3/s.$$

With the quench section diameter of 8 inches (cross-sectional area=0.032 $m^2$), the velocity of the burned gas through the quench section is $$4.1\ m^3/s \div 0.032\ m^2=128\ m/s=v_b.$$

The quench air jet velocity is calculated in a similar fashion. The quench air jet mass flow rate is 45% of 20 lb/s, or 9 lb/s (4.1 kg/s), so the volumetric flow of the quench air jets is $$4.1\ kg/s \div 5.3\ kg/m^3=0.77\ m^3/s.$$

and the velocity of the quench air jets is $$0.77\ m^3/s \div 0.00871\ m^2=89\ m/s=v_j.$$

In this example, these values of $\rho_b$, $\rho_j$, $v_b$, and $v_j$ yield a value of $Y_{max}/d_{hole}$=1.34.

Combining this value for $Y_{max}/d_{hole}$ with the already determined maximum penetration depths for the large and small quench jets determines the diameters of the large and small quench holes: 1.93 and 0.44 inches, respectively. The cross-sectional area of a single large hole is 2.92 $in^2$, while and the cross-sectional area of a single small hole is 0.15 $in^2$.

The last step is to calculate the number of holes of each type. In this example, the total open area for the larger holes is 6.75 $in^2$, so the total number of large holes should be $$6.75\ in^2 \div 2.92\ in^2=2.3\ holes$$

and the number of small holes should be $$6.75\ in^2 \div 0.15\ in^2=45\ holes.$$

Because the number of holes must be an integer, the designer will round these calculations to the nearest integer result.

It will be obvious to one skilled in the art how to modify the method outlined here to include discharge coefficients in these calculations, to reflect differences between geometric areas and effective flow areas.

EXAMPLE 1

| Test Conditions | |
|---|---|
| Rich Stage/Lean Stage Air Flow Rate Ratio | 40/60 |
| Low Heating Value Fuel Temperature | 640° F. |
| Low Heating Value Fuel Flow Rate | 0.5–1.3 lb/s |
| Rich Stage Air Temperature | 700 F |
| Rich Stage Air Flow Rate | 1.4 lb/s |
| Lean Stage Air Temperature | 710 F |
| Lean Stage Air Flow Rate | 2.1 lb/s |

| Fuel Composition | |
|---|---|
| Species | Mole Percent |
| CO | 8.6 |
| $H_2$ | 17.3 |
| $CH_4$ | 2.7 |
| $N_2$ | 30.1 |
| $CO_2$ | 12.6 |
| $H_2O$ | 28.0 |
| Ar | 0.3 |
| $NH_3$ | 0.4 |
| Total | 100.0 |

Figure 5:
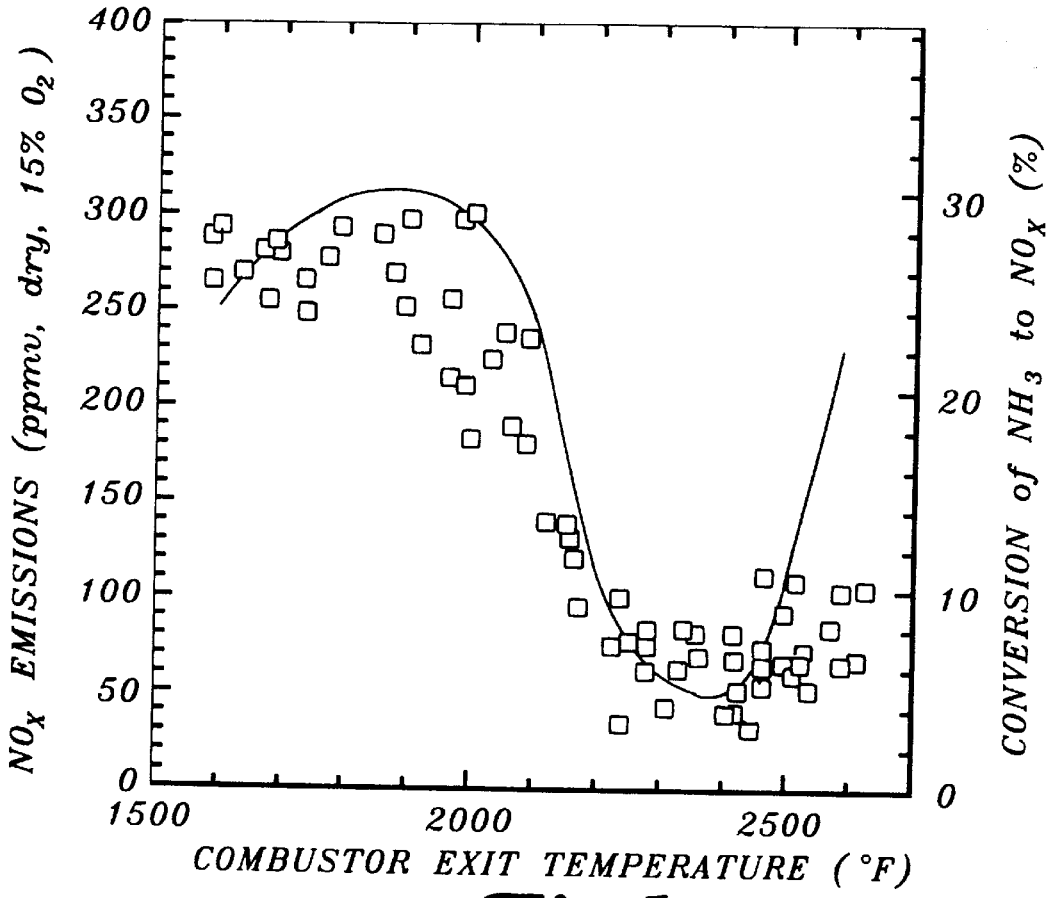
FIG. 5 is a graphical illustration of the NOx emissions levels at various combustor exit temperatures in accordance with one embodiment of the instant invention.
Figure 6:
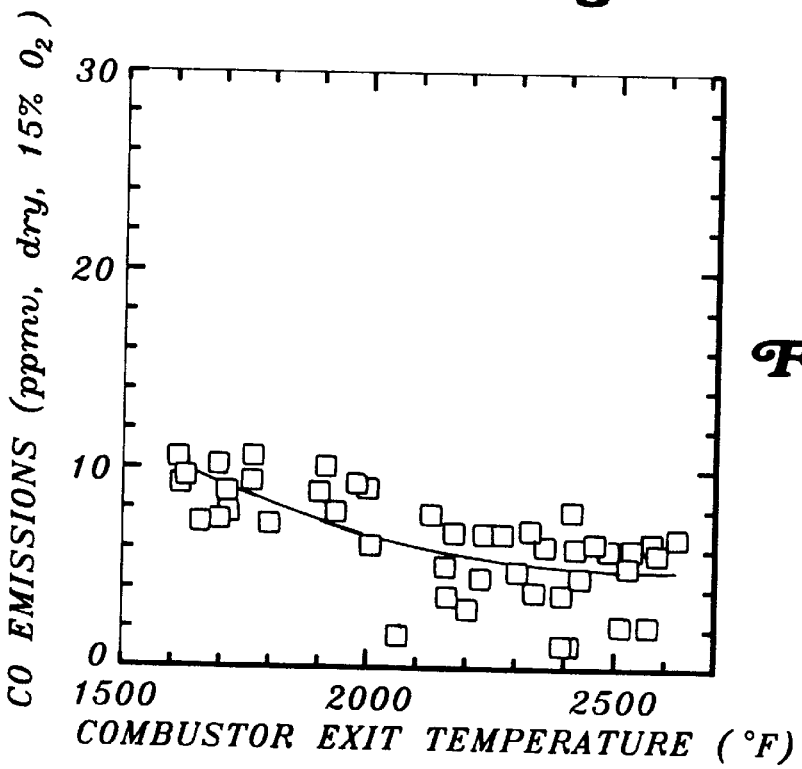
FIG. 6 is a graphical illustration of the CO emissions levels at various combustor exit temperatures in accordance with one embodiment of the instant invention.

A model rich-quench-lean combustor 14 in accordance with one embodiment of the instant invention was tested under the conditions listed above. FIG. 5 shows measured NOx emissions with an air split of 40% rich/60% lean. With the 40/60 air split, the minimum in NOx emissions occurred at a combustor exit temperature of about 2400 F. The minimum NOx occurred at a rich stage equivalence ratio of about $Ø_{rich}$ A 1.25. At the optimum rich stage equivalence ratio, NOx emissions were about 50 ppmv (on a dry, 15% $O_2$ basis. With approximately 4600 parts per million (ppmv) $NH_3$ in the fuel, this corresponds to a conversion of $NH_3$ to NOx of about 5%. At the optimum conditions, NOx emissions were more than a factor of three lower than a conventional diffusion flame combustor burning the same or similar fuel (See Fuel Composition Table above). For example, in previous pilot plant tests utilizing a conventional diffusion flame combustor, the conversion of $NH_3$ to NOx ranged from about 20% to about 80%, depending upon the combustor exit temperature. As shown in FIG. 6, the measured CO emissions for the model rich-quench-lean combustor 14 discussed above were between about 5 and about 30 ppmv (dry, 15% O2) under all conditions, indicating the quench stage design provided adequate mixing, and the short lean stage provided sufficient residence time to complete combustion. Accordingly, the instant invention discloses a rich-quench-lean combustor design that achieves rapid mixing of quench air and rich stage burned gas while maintaining extremely low emission levels and low pressure drop across the quench stage.

While only certain features of the invention have been illustrated and described herein, many modifications and changes will occur to those skilled in the art. It is, therefore, to be understood that the appended claims are intended to cover all such modifications and changes as fall within the true spirit of the invention.

We claim:

1. A combustor cooperating with a compressor in driving a gas turbine, said combustor comprising:

a cylindrical outer combustor casing;

a combustion liner having an upstream rich section, a quench section and a downstream lean section, said combustion liner disposed within said outer combustor casing defining a combustion chamber, said quench section having at least a core region and an outer region;

at least a first plurality of quench holes disposed within said liner at said quench section, said first quench holes sized so as to provide a core cooling jet penetration to said core region of said quench section; and at least a second plurality of quench holes disposed within said liner at said quench section, said second quench holes sized so as to provide an outer cooling jet penetration to said outer region of said quench section.

2. A combustor in accordance with claim 1, further comprising a middle region occupying the space between said core region and said outer region and a third plurality of quench holes disposed within said liner at said quench section, said third plurality of quench holes sized so as to provide a middle cooling jet penetration to said middle region of said quench section.

3. A combustor in accordance with claim 1, wherein said rich section comprises a cylindrical section and a conical section, said conical section provided so as to reduce flow path diameter and to prevent recirculating flow from drawing said lean section gases upstream into said rich section.

4. A combustor in accordance with claim 1, wherein said quench section comprises a cylindrical section and a backward facing step disposed at the entrance to said lean section.

5. A combustor in accordance with claim 1, wherein said core region occupies the space between a centerpoint and one half of the radial distance between said centerpoint and said combustion liner and said outer region occupies the space between one half of the radial distance between said centerpoint and said combustion liner.

6. A combustor in accordance with claim 1, wherein said core region occupies one half of the cross-section area of said quench section and said outer region occupies one half of said cross-sectional area of said quench section.

7. A combustor in accordance with claim 1, wherein said first plurality of quench holes comprises between about 2 to about 10 quench holes.

8. A combustor in accordance with claim 1, wherein said first plurality of quench holes comprise a diameter in the range between about 0.1 in. to about 2.0 in.

9. A combustor in accordance with claim 1, wherein said first plurality of quench holes are spaced about the periphery of quench section in the range between about 30° to about 180° apart with respect to one another.

10. A combustor in accordance with claim 1, wherein said second plurality of quench holes comprise between about 20 to about 60 quench holes.

11. A combustor in accordance with claim 1, wherein said second plurality of quench holes comprise a diameter in the range between about 0.05 in. to about 0.3 in.

12. A combustor in accordance with claim 1, wherein said second plurality of quench holes are spaced about the periphery of quench section in the range between about 5° to about 20° apart with respect to one another.

13. A combustor in accordance with claim 1, wherein said second plurality of quench holes are axially offset from said first plurality of said quench holes in the range between about 0.05 in. to about 0.3 in.

14. A combustor in accordance with claim 1, wherein said respective first and second plurality of quench holes are respectively sized such that said core region and said outer region receive an amount of quench air which is proportional to the respective cross-sectional area of said regions.

15. A combustor cooperating with a compressor in driving a gas turbine, said combustor comprising:

a cylindrical outer combustor casing;

a combustion liner having an upstream rich section, a quench section and a downstream lean section, said combustion liner disposed within said outer combustor casing defining a combustion chamber, said quench section having at least a core region, a middle region and an outer region;

at least a first plurality of quench holes disposed within said liner at said quench section, said first quench holes sized so as to provide cooling jet penetration to said core region of said quench section;

at least a second plurality of quench holes disposed within said liner at said quench section, said second quench holes sized so as to provide cooling jet penetration to said middle region of said quench section, and at least a third plurality of quench holes disposed within said liner at said quench section, said third plurality of quench holes sized so as to provide cooling jet penetration to said outer region of said quench section.

16. A combustor in accordance with claim 15, wherein said core region occupies the space between a centerpoint and one third of the radial distance between said centerpoint and said combustion liner, said middle region occupies the space between one third of the radial distance from said centerpoint and two thirds of the radial distance from said centerpoint and said combustion liner and said outer region occupies the space between two thirds of the radial distance and said combustion liner.

17. A combustor in accordance with claim 15, wherein aid core region, said middle region and said outer section each occupy one third of the cross-sectional area of said quench section.

18. A combustor in accordance with claim 15, wherein said first plurality of quench holes comprise between about 2 to about 10 quench holes.

19. A combustor in accordance with claim 15, wherein said first plurality of quench holes comprise a diameter in the range between about 0.1 in. to about 2.0 in.

20. A combustor in accordance with claim 15, wherein said first plurality of quench holes are spaced about the periphery of quench section in the range between about 30° to about 180° apart with respect to one another.

21. A combustor in accordance with claim 15, wherein said second plurality of quench holes comprise between about 20 to about 60 quench holes.

22. A combustor in accordance with claim 15, wherein said second plurality of quench holes comprise a diameter in the range between about 0.05 in. to about 0.3 in.

23. A combustor in accordance with claim 15, wherein said second plurality of quench holes are spaced about the periphery of quench section in the range between about 5° to about 20° apart with respect to one another.

24. A combustor in accordance with claim 15, wherein said second plurality of quench holes are axially offset from said first plurality of said quench holes in the range between about 0.05 in. to about 0.3 in.

25. A combustor in accordance with claim 15, wherein said third plurality of quench holes comprise between about 100 to about 500 quench holes.

26. A combustor in accordance with claim 15, wherein said third plurality of quench holes comprise a diameter in the range between about 0.005 in. to about 0.1 in.

27. A combustor in accordance with claim 15, wherein said third plurality of quench holes are spaced about the periphery of quench section in the range between about 0.5° to about 7° apart with respect to one another.

28. A combustor in accordance with claim 15, wherein said third plurality of quench holes are axially offset from said first plurality of quench holes in the range between about 0.1 in. to about 0.3 in. and from said second plurality of quench holes in the range between about 0.05 in. to about 0.2 in.

29. A combustor cooperating with a compressor in driving a gas turbine, said combustor comprising:

a cylindrical outer combustor casing;

a combustion liner having an upstream rich section, a quench section and a downstream lean section, said combustion liner disposed within said outer combustor casing defining a combustion chamber, said quench section having at least a core region, a first middle region, a second middle region and an outer region;

at least a first plurality of quench holes disposed within said liner at said quench section, said first quench holes sized so as to provide cooling jet penetration to said core region of said quench section;

at least a second plurality of quench holes disposed within said liner at said quench section, said second quench holes sized so as to provide cooling jet penetration to said first middle region of said quench section;

at least a third plurality of quench holes disposed within said liner at said quench section, said third plurality of quench holes sized so as to provide cooling jet penetration to said second middle region of said quench section; and at least a fourth plurality of quench holes disposed within said liner at said quench section, said fourth plurality of quench holes sized so as to provide cooling jet penetration to said outer region of said quench section.

30. A method of determining quench hole configuration for a rapid-quench axially staged combustor including a combustion liner having an upstream rich section, a quench section and a downstream lean section, said combustor having an air flow rate, a fuel flow rate, an operating pressure, a compressor discharge air temperature and a total pressure drop, said method comprising the steps of:

determining the total open area of said combustor liner from said air flow rate, said fuel flow rate, said operating pressure, said compressor discharge air temperature and said total pressure drop;

apportioning said total open area to each of said rich section, said quench section and said lean section;

choosing a number of regions of said quench section;

sizing said quench holes such that the cooling jet penetration distance is at about a center of a respective region; and determining the number of said quench holes to provide cooling jet penetration to each of said respective regions from the size of said quench holes and the apportioned total open area of each of said regions.

* * * * *